US009389526B2

(12) United States Patent
Ozawa et al.

(10) Patent No.: US 9,389,526 B2
(45) Date of Patent: Jul. 12, 2016

(54) ELECTROSTATIC LATENT IMAGE DEVELOPING TONER

(71) Applicant: KYOCERA Document Solutions Inc., Osaka (JP)

(72) Inventors: Yoshio Ozawa, Osaka (JP); Noriaki Sakamoto, Osaka (JP); Hiroaki Moriyama, Osaka (JP); Tomoyuki Ogawa, Osaka (JP); Takatoshi Nozaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 9 days.

(21) Appl. No.: 14/324,731

(22) Filed: Jul. 7, 2014

(65) Prior Publication Data

US 2015/0017582 A1 Jan. 15, 2015

(30) Foreign Application Priority Data

Jul. 11, 2013 (JP) ..... 2013-145706

(51) Int. Cl.
*G03G 9/08* (2006.01)
*G03G 9/113* (2006.01)
*G03G 9/093* (2006.01)

(52) U.S. Cl.
CPC ..... *G03G 9/0825* (2013.01); *G03G 9/09328* (2013.01); *G03G 9/09371* (2013.01); *G03G 9/09392* (2013.01); *G03G 9/1137* (2013.01)

(58) Field of Classification Search
CPC .. G03G 9/0825; G03G 9/1133; G03G 9/1135
See application file for complete search history.

(56) References Cited

U.S. PATENT DOCUMENTS 4,980,257 A * 12/1990 Anno ..... G03G 9/0825 428/407
2005/0271964 A1 12/2005 Etou et al.
2008/0057434 A1* 3/2008 Itoh ..... G03G 9/0806 430/137.15

FOREIGN PATENT DOCUMENTS

JP 2004-138985 A 5/2004

* cited by examiner

*Primary Examiner* — Thorl Chea
(74) *Attorney, Agent, or Firm* — Studebaker & Brackett PC

(57) ABSTRACT

An electrostatic latent image developing toner includes toner particles each including a toner core and a shell layer. The shell layer contains a resin including a unit derived from a monomer of a thermosetting resin and a unit derived from a thermoplastic resin. The thermosetting resin is one or more resins selected from the group of amino resins consisting of a melamine resin, a urea resin, and a glyoxal resin. When heat and pressure are applied to a toner layer formed on a polyester film under conditions of a temperature of 140° C. and a pressure of 7 MPa so that the toner particles are not superimposed, the toner particles of the toner layer are broken in a manner that a melt of a component of the toner core flows out from a plurality of points in an outer surface of the shell layer.

6 Claims, 2 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2013-145706, filed Jul. 11, 2013. The contents of this application are incorporated herein by reference in their entirety.

BACKGROUND

The present disclosure relates to electrostatic latent image developing toners.

For energy saving and downsizing of image forming apparatuses, there is a demand for a toner excellent in low-temperature fixability. The use of a toner excellent in the low-temperature fixability enables the toner to be satisfactorily fixed on a recording medium even when the temperature of a fixing roller is low.

In order to obtain the toner excellent in the low-temperature fixability, a toner producing method has been proposed which uses a binder resin having a low melting point (or a binder resin having a low glass transition point) and a mold releasing agent having a low melting point. However, it is difficult to produce a toner excellent in high-temperature preservability by this method. The high-temperature preservability of a toner exhibits a property that toner particles contained in the toner are not aggregated even when the toner is stored under a high temperature environment. Toner particles of a toner poor in the high-temperature preservability are liable to aggregate under a high temperature environment. When the toner particles aggregate, the charge amount of the toner particles may be likely to decrease.

For purpose of improving the low-temperature fixability, high-temperature preservability, and blocking resistance of a toner, a toner containing toner particles each having a core-shell structure has been proposed.

In an exemplified toner containing toner particles each having a core-shell structure, a toner core contains a binder resin having a low melting point. Further, the toner core is coated with a shell layer made from a resin. In addition, the resin forming the shell layer has a higher glass transition point (Tg) than the binder resin contained in the toner core.

In another exemplified toner containing toner particles each having a core-shell structure, the surface of a toner core is coated with a thin film (shell layer) containing a thermosetting resin. The toner core has a softening point of 40° C. or more and 150° C. or less.

SUMMARY

An electrostatic latent image developing toner according to the present disclosure includes toner particles each including a toner core containing a binder resin, and a shell layer coating a surface of the toner core. The shell layer contains a resin including a unit derived from a monomer of a thermosetting resin and a unit derived from a thermoplastic resin. The thermosetting resin is one or more resins selected from the group of amino resins consisting of a melamine resin, a urea resin, and a glyoxal resin. When heat and pressure are applied to a toner layer formed on a polyester film under conditions of a temperature of 140° C. and a pressure of 7 MPa so that the toner particles are not superimposed, the toner particles of the toner layer are broken in a manner that a melt of a component of the toner core flows out from a plurality of points in an outer surface of the shell layer.

DETAILED DESCRIPTION

Figure 1:
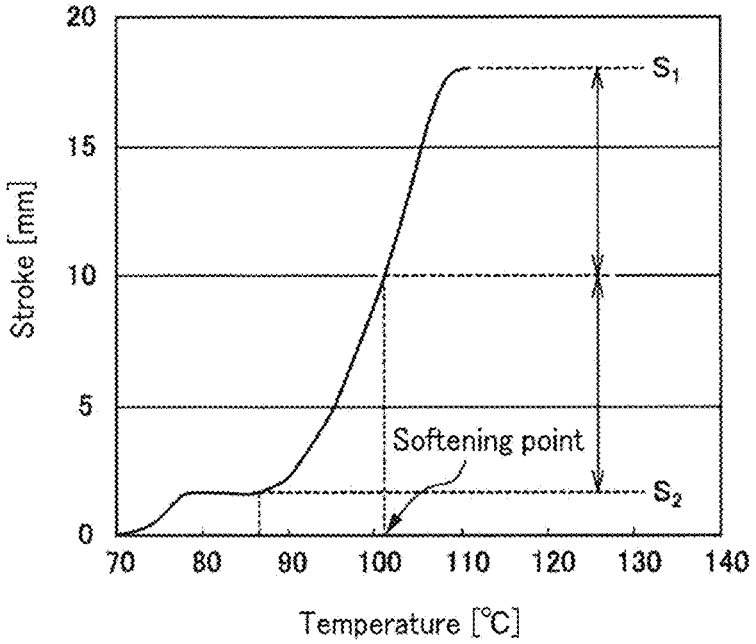
FIG. 1 is a graph representation explaining a method for measuring a softening point by using an elevated flow tester.

An embodiment of the present disclosure will now be described in detail. The present disclosure is not limited to the following embodiment at all, but can be practiced with changes and modifications appropriately made within the scope of the object of the present disclosure. It should be noted that the description may be appropriately omitted in some cases for avoiding redundant description, which does not limit the gist of the present disclosure.

A toner according to the present embodiment is an electrostatic latent image developing toner. Toner particles contained in the toner each have a toner core and a shell layer coating the toner core. The toner core contains a binder resin. Besides, the toner core may contain, in the binder resin, a component such as a colorant, a mold releasing agent, a charge control agent, or a magnetic powder, if necessary. The shell layer is mainly constituted by a resin. The resin constituting the shell layer contains a unit derived from a monomer of a thermosetting resin and a unit derived from a thermoplastic resin.

The toner may contain the toner particles alone, or may contain a component other than the toner particles. An external additive may be attached to the surfaces of the toner particles as occasion demands. The toner may be mixed with a desired carrier, so as to be prepared as a two-component developer. It is noted that a particle obtained before the treatment with an external additive is sometimes called a toner mother particle.

When heat and pressure are applied to a toner layer of the toner in the present embodiment formed on a polyester film under conditions of a temperature of 140° C. and a pressure of 7 MPa so that the toner particles are not superimposed, the toner particles of the toner layer are broken in a manner that a melt of a component of the toner core flows out from a plurality of points in the outer surface of the shell layer. In the toner having such a constitution, breakage of the shell layer and melting of the toner core tend to proceed rapidly. For this reason, the toner in the present embodiment is excellent in low-temperature fixability. The cause of breakage of the toner particles of the toner in the present embodiment might be as follows.

It can be inferred that when heat and pressure are applied to the toner layer (in turn, the toner particles), thin portions of the shell layer are locally broken with priority to form many minute breaking points (holes) in the surface of the shell layer and allows a melt of a component of the toner core to flow out from the formed breaking points. In the toner of the present embodiment, the sell layer is constituted by a composite film of a thermosetting resin and a thermoplastic resin. Therefore, application of heat and pressure in fixing tends to form minute distortion at portions of the shell layer where a unit derived from a monomer of the thermosetting resin and a unit derived from a thermoplastic resin are present. For the reason as above, it can be inferred that the toner particles of the toner according to the present embodiment are broken.

Further, where the toner core contains a colorant or a mold releasing agent, the colorant or the mold releasing agent tends to be present in the vicinity of the surface of the toner core. In the vicinity of the surface of the toner core, the strength of the shell layer may decrease more at a portion where the binder resin is present than at a portion where the colorant or the mold releasing agent is present. For this reason, the toner particles seems to be readily broken in the toner having such a constitution.

Besides, production of the toner core by an aggregation method described later may cause distortion in the shell layer. Further, projections and recesses tend to be formed in the surface of the toner core produced by the aggregation method. The portions of the shell layer formed over the recesses of the toner core are loose and out of contact with the toner core. For this reason, application of heat and pressure readily breaks the toner particles. Accordingly, the toner particles each including the toner core produced by the aggregation method might be readily broken.

By contrast, where the toner core is produced by a melt kneading method described later, the surface tension caused by heating in forming the shell layer contracts the toner core. Therefore, distortion may tend to be caused in the shell layer formed on the surface of the toner core more readily than on the surface of the toner core produced by the aggregation method. On the surface of the toner core produced by the melt kneading method, more projections and recesses tend to be formed than on the surface of the toner core produced by the aggregation method. The portions of the shell layer formed over the recesses of the toner core are readily broken by application of heat and pressure to the toner particle. For this reason, the toner particles including the toner core produced by the melt kneading method are broken more readily than those including the toner core produced by the aggregation method.

Furthermore, the shell layer in the toner of the present embodiment contains the unit derived from the monomer of the thermosetting resin and the unit derived from the thermoplastic resin. The unit derived from the thermoplastic resin is a unit with high molecular weight, while the unit derived from the monomer of the thermosetting resin is a unit with low molecular weight. For this reason, non-homogeneous dispersion of the unit derived from the thermoplastic resin in the shell layer may cause irregularity in thickness of the shell layer. In turn, the shell layer in the toner of the present embodiment might be irregular in thickness, and thin portions tend to be dotted. For the reason as above, it can be inferred that the toner particles are broken in the toner according to the present embodiment.

In order to readily cause breakage of the toner particles, it is preferable that the rate Sx of change in specific surface area, measured by the following method, of the toner is 35% or more. Where the shell layer has a thickness of 20 nm or more, the rate Sx of change in specific surface area tends to reduce. Further, it is through that where the rate Sx of change in specific surface are is 200% or more, the coverage of the shell layer may be insufficient, thereby reducing the high-temperature preservability of the toner.

<Method for Measuring Rate Sx of Change in Specific Surface Area>

A part of a sample (toner to be measured) is subjected to alkaline treatment through obtaining a dispersion by dispersing 10 g of toner in 50 mL of a basic aqueous solution of pH 10 containing an anionic surfactant (e.g., "Maipetto" manufactured by Kao Corporation), allowing the obtained dispersion to stand still at 50° for 10 hours; and drying a solid content separated from the standing dispersion. Portions of the shell layer that are thin or that are weakly bound to the toner core are liable to be invaded with alkalis. It is thought that when an alkali reaches the toner core, a hydrolysis is caused to decompose the toner core, thereby forming recesses in the surface of the toner particle.

The rate Sx of change in specific surface area of the sample (toner) can be obtained from the specific surface area Sb of the sample (toner) having been subjected to the alkaline treatment and the specific surface area of the sample (toner) before the treatment in accordance with an equation $Sx=100\times(Sb-Sa)/Sa$.

Description will now be made about, the toner core (the binder resin, the colorant, the mold releasing agent, the charge control agent, and the magnetic powder), the shell layer, the external additive, the carrier used when the toner is used in a two-component developer, and a method for producing the toner in this order.

[Binder Resin]

In the toner of the present embodiment, the shell layer is formed on the surface of the toner core through a reaction, caused on the surface of the toner core, between the thermoplastic resin and the monomer (or initial polymer) of the thermosetting resin. In order to firmly bind the shell layer to the toner core, it is preferable that the binder resin has a reactive functional group that is bound chemically in a reaction with a monomer or a prepolymer of a thermosetting resin such as methylol melamine. For example, the binder resin is preferably a resin having, in a molecule, a functional group such as a hydroxyl group, a carboxyl group, and an amino group, and is more preferably a resin having, in a molecule, a polar group such as a hydroxyl group, a carboxyl group, and/or an ester group. It is considered that the condensation reaction between the functional group that the toner core has and materials of the shell layer might progress simultaneously with in-situ polymerization of the materials of the shell layer (specifically, the monomer or the prepolymer of the resin constituting the shell layer).

Where the binder resin has a carboxyl group, the binder resin has an acid value of preferably 3 mgKOH/g or more and 50 mgKOH/g or less, and more preferably 10 mgKOH/g or more and 40 mgKOH/g or less. Where the binder resin has a hydroxyl group, the binder resin has a hydroxyl value of preferably 10 mgKOH/g or more and 70 mgKOH/g or less, and more preferably 15 mgKOH/g or more and 50 mgKOH/g or less.

Specific examples of the binder resin include thermoplastic resins such as styrene based resins, acrylic resins, styrene acrylic resins, polyethylene based resins, polypropylene based resins, vinyl chloride based resins, polyester based resins, polyamide based resins, polyurethane based resins, polyvinyl alcohol based resins, vinyl ether based resins, N-vinyl based resins, and styrene-butadiene based resins. Among these resins, a styrene acrylic resin or a polyester resin is preferably used from the viewpoint of improvement of the dispersibility of a colorant in the toner particles, the chargeability of the toner, and the fixability of the toner on a recording medium. The styrene acrylic resin and the polyester resin will now be described.

The styrene acrylic resin is a copolymer of a styrene based monomer and an acrylic monomer. Specific examples of the styrene based monomer include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene. Specific examples of the acrylic monomer include (meth)acrylic acid; (meth)acrylic acid alkyl ester such as methyl (meth)acrylate, ethyl (meth)acrylate, n-propyl (meth)acrylate, iso-propyl (meth)acrylate, n-butyl (meth)acrylate, iso-butyl (meth)acrylate, or 2-ethylhexyl (meth)acrylate; and (meth)acrylic acid hydroxyalkyl ester such as 2-hydroxyethyl (meth)acrylate, 3-hydroxypropyl (meth)acrylate, 2-hydroxypropyl (meth)acrylate, or 4-hydroxypropyl (meth)acrylate.

In preparation of the styrene acrylic resin, a hydroxy group can be introduced into the styrene acrylic resin by using a monomer such as p-hydroxystyrene, m-hydroxystyrene, or (meth)acrylic acid hydroxyalkyl ester. Appropriate adjustment of the amount of such a monomer having a hydroxyl group to be used can result in adjustment of the hydroxyl value of the resultant styrene acrylic resin.

In preparation of the styrene acrylic resin, a carboxyl group can be introduced into the styrene acrylic resin by using (meth)acrylic acid as the monomer. Appropriately adjustment of the amount of the (meth)acrylic acid to be used can result in adjustment of the acid value of the resultant styrene acrylic resin.

The polyester resin can be obtained by condensation polymerization or co-condensation polymerization of a bivalent, trivalent, or higher valent alcohol and a bivalent, trivalent, or higher valent carboxylic acid. Examples of components used in synthesizing the polyester resin include the following alcohols and carboxylic acids.

Specific examples of a bivalent alcohol used in synthesizing the polyester resin include diols such as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenols such as bisphenol A, hydrogenated bisphenol A, polyoxyethylenated bisphenol A, and polyoxypropylene-modified bisphenol A.

Specific examples of a trivalent or higher valent alcohol used in synthesizing the polyester resin include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methyl propanetriol, 2-methyl-1,2,4-butanetriol, trimethylolethane, trimethylolpropane, and 1,3,5-trihydroxymethylbenzene.

Specific examples of a bivalent carboxylic acid used include maleic acid, fumaric acid, citraconic acid, itaconic acid, glutaconic acid, phthalic acid, isophthalic acid, terephthalic acid, cyclohexane dicarboxylic acid, adipic acid, sebacic acid, azelaic acid, malonic acid, succinic acid, and alkyl succinic acid, and alkenyl succinic acid (n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, and isododecenyl succinic acid).

Specific examples of a trivalent or higher valent carboxylic acid include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

Furthermore, any of the aforementioned bivalent, trivalent, or higher valent carboxylic acids may be used in the form of an ester-forming derivative such as an acid halide, an acid anhydride, or a lower alkyl ester. Here, a "lower alkyl" means an alkyl group having 1 to 6 carbon atoms.

The acid value and the hydroxyl value of the polyester resin can be adjusted by appropriately changing the amount of a bivalent, trivalent or higher valent alcohol to be used and the amount of a bivalent, trivalent or higher valent carboxylic acid to be used in producing the polyester resin. Besides, the acid value and the hydroxyl value of the polyester resin tend to reduce by increasing the molecular weight of the polyester resin.

From the viewpoint of carbon neutral, the toner according to the present disclosure preferably contains a biomass-derived material. Specifically, the ratio of biomass-derived carbon in entire carbon contained in the toner is preferably 25% by mass or more and 90% by mass or less.

As the binder resin, a polyester resin synthesized by using a biomass-derived alcohol, such as 1,2-propanediol, 1,3-propanediol, or glycerin is preferably used.

The type of biomass is not especially limited, and the biomass may be plant biomass or animal biomass. Among various biomass-derived materials, a plant biomass-derived material is more preferably used because such a material is easily available in a large amount and is inexpensive.

An example of a method for producing glycerin from biomass includes a method in which vegetable oil or animal oil is hydrolyzed by a chemical method using an acid or a base, or by a biological method using an enzyme or microorganism. Alternatively, glycerin may be produced from a substrate containing saccharides such as glucose by a fermentation method. Alcohol such as 1,2-propanediol or 1,3-propanediol can be produced by using, as a raw material, the glycerin obtained as described above. The glycerin can be chemically transformed into a target substance by a known method.

As the binder resin, a styrene acrylic resin synthesized by using a monomer of biomass-derived acrylic acid or acrylic ester is preferably used. By dehydrating the glycerin obtained as described above, acrolein can be obtained. Besides, by oxidizing the obtained acrolein, biomass-derived acrylic acid can be obtained. Furthermore, by esterifying the obtained biomass-derived acrylic acid by a known method, biomass-derived acrylic ester can be produced. Where alcohol used in producing acrylic ester is methanol or ethanol, alcohol produced from biomass by a known method is preferably used.

The concentration of $CO_2$ containing radioactive carbon ($^{14}C$) in $CO_2$ present in the air is kept constant in the air. By contrast, plants incorporate $CO_2$ containing $^{14}C$ from the air during photosynthesis. Therefore, the concentration of $^{14}C$ in carbon contained in an organic component of a plant is occasionally equivalent to the concentration of $CO_2$ containing $^{14}C$ in the air. The concentration of $^{14}C$ in carbon contained in an organic component of a general plant is approximately 107.5 percent Modem Carbon (pMC). Further, carbon present in animals is derived from carbon contained in plants. For this reason, the concentration of $^{14}C$ in carbon contained in an organic component of an animal also shows a similar tendency to that in a plant.

Assuming that the concentration of $^{14}C$ contained in the toner is X (pMC), the ratio of biomass-derived carbon in entire carbon contained in the toner can be obtained in accordance with Formula (I): Ratio of biomass-derived carbon (% by mass)=(X/107.5)×100.

From the viewpoint of the carbon neutral, a plastic product containing biomass-derived carbon in a ratio of 25% by mass or more in entire carbon contained in the product is particularly preferred. Such a plastic product is given a BiomassPla mark (certified by Japan BioPlastics Association). Where the ratio of the biomass-derived carbon in entire carbon contained in the toner is 25% by mass or more, the concentration X of $^{14}C$ in the toner is obtained in accordance with Formula (I) above as 26.9 pMC or more. Accordingly, the polyester resin is preferably prepared so that the concentration of the radioactive carbon isotope $^{14}C$ in the entire carbon contained in the toner can be 26.9 pMC or more. It is noted that the concentration of $^{14}C$ carbon contained in a petrochemical can be measured in accordance with ASTM-D6866.

The glass transition point ($Tg_r$) of the binder resin is preferably 30° C. or more and 60° C. or less, and more preferably 35° C. or more and 55° C. or less. The glass transition point ($Tg_r$) of the binder resin can be measured by the following method.

<Method for Measuring Glass Transition Point>

The glass transition point ($Tg_r$) of the binder resin can be obtained on the basis of a heat absorption curve of the binder resin (more specifically, a point of change in specific heat of the binder resin) measured by using a differential scanning calorimeter (DSC) (e.g., "DSC-6200" manufactured by Seiko Instruments Inc.). For example, 10 mg of the binder resin (measurement sample) is put in an aluminum pan, and an empty aluminum pan is used as a reference. A heat absorption curve of the binder resin is obtainable through measurement performed under conditions of a measurement temperature range from 25° C. to 200° C. and a temperature increasing rate of 10° C./min. The glass transition point ($Tg_r$) of the binder resin can be obtained on the basis of this heat absorption curve of the binder resin.

The binder resin has a softening point ($Tm_r$) of preferably 60° C. or more and 150° C. or less, and more preferably 70° C. or more and 140° C. or less. Alternatively, a plurality of resins having different softening points (Tm) can be combined to obtain a binder resin having a softening point ($Tm_r$) falling in the aforementioned range. The glass transition point ($Tm_r$) of the binder resin can be measured by the following method.

<Method for Measuring Softening Point>

The softening point ($Tm_r$) of the binder resin can be measured by using an elevated flow tester (e.g., "CFT-500D" manufactured by Shimadzu Corporation). For example, the softening point ($Tm_r$) can be measured by setting the binder resin (measurement sample) on the elevated flow tester and causing 1 $cm^3$ of the sample to be melt flown under conditions of a die diameter of 1 mm, a plunger load of 20 $kg/cm^2$, and a temperature increasing rate of 6° C./min. By the measurement with the elevated flow tester, an S shaped curve pertaining to the temperature (° C.)/stroke (mm) can be obtained. The softening point ($Tm_r$) of the binder resin can be read from the obtained S shaped curve.

A method for reading the softening point ($Tm_r$) of the binder resin will be described with reference to FIG. 1. By the measurement with the elevated flow tester, an S shaped curve, for example, as illustrated in FIG. 1 can be obtained. It is assumed in this S shaped curve that the maximum value of the stroke is $S_1$ and that a stroke value corresponding to a low-temperature-side base line is $S_2$. On the S shaped curve, a temperature corresponding to a stroke value of $(S_1+S_2)/2$ corresponds to the softening point ($Tm_r$) of the binder resin (measurement sample).

Where a polyester resin is used as the binder resin, the polyester resin has a number average molecular weight (Mn) of preferably 1100 or more and 2000 or less. A molecular weight distribution (Mw/Mn) of the polyester resin expressed as a ratio between the number average molecular weight (Mn) and the mass average molecular weight (Mw) of the polyester resin is preferably 9 or more and 21 or less. Where a styrene acrylic resin is used as the binder resin, the styrene acrylic resin has a number average molecular weight (Mn) of preferably 2000 or more and 3000 or less. A molecular weight distribution (Mw/Mn) of the styrene acrylic resin expressed as a ratio between the number average molecular weight (Mn) and the mass average molecular weight (Mw) of the styrene acrylic resin is preferably 10 or more and 20 or less. The number average molecular weight (Mn) and the mass average molecular weight (Mw) of the binder resin can be measured by gel permeation chromatography.

[Colorant]

The toner core may contain a colorant if necessary. As the colorant, any of known pigments or dyes can be used according to the color of the toner particles. Specific examples of the colorant suitably used include the following.

An example of a black colorant includes carbon black. Alternatively, a colorant whose color is adjusted to black by using colorants such as a yellow colorant, a magenta colorant, and a cyan colorant described later may be used as the black colorant.

Where the toner is a color toner, examples of the colorant mixed with the toner core include a yellow colorant, a magenta colorant, and a cyan colorant.

Examples of the yellow colorant include condensed azo compounds, isoindolinone compounds, anthraquinone compounds, azo metal complexes, methine compounds, and allylamide compounds. Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Bat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. A specific example of the magenta colorant includes C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

Examples of the cyan colorant include copper phthalocyanine compounds, copper phthalocyanine derivatives, anthraquinone compounds, and basic dye lake compounds. Specific examples of the cyan colorant include C.I. Pigment Blue (1, 7, 15, 15:1, 15:2, 15:3, 15:4, 60, 62, or 66), phthalocyanine blue, C.I. Bat Blue, and C.I. Acid Blue.

The amount of the colorant to be used is preferably 1 part by mass or more and 20 parts by mass or less, and more preferably 3 parts by mass or more and 10 parts by mass or less based on 100 parts by mass of the binder resin.

[Mold Releasing Agent]

The toner core may contain a mold releasing agent if necessary. The mold releasing agent is used generally for purpose of improving the fixability or the offset resistance of the toner.

Suitable examples of the mold releasing agent include aliphatic hydrocarbon waxes such as low molecular weight polyethylene, low molecular weight polypropylene, polyolefin copolymers, polyolefin wax, microcrystalline wax, paraffin wax, and Fischer-Tropsch wax; oxides of the aliphatic hydrocarbon waxes such as polyethylene oxide wax and a block copolymer of polyethylene oxide wax; vegetable based waxes such as candelilla wax, carnauba wax, haze wax, jojoba wax, and rice wax; animal based waxes such as beeswax, lanolin, and spermaceti wax; mineral waxes such as ozokerite, ceresin, and petrolatum; waxes containing a fatty acid ester as a principal component such as montanic acid ester wax, and castor wax; and waxes obtained by deoxidizing part or whole of fatty acid ester such as deoxidized carnauba wax.

The amount of the release agent to be used is preferably 1 part by mass or more and 30 parts by mass or less, and more preferably 5 parts by mass or more and 20 parts by mass or less based on 100 parts by mass of the binder resin.

[Charge Control Agent]

A charge control agent is used for purpose of improving the charge level or the charge rising property of a toner, so as to obtain a toner excellent in the durability or the stability. The charge rising property of a toner is an index as to whether or not the toner can be charged to prescribed charge level in a short period of time.

Where development is performed with the toner positively charged, a positively chargeable charge control agent is preferably used. Where the development is performed with the toner negatively charged, a negatively chargeable charge control agent is preferably used. However, if sufficient chargeability is secured in the toner, there is no need to use a charge control agent. For example, where a component having a charging function is contained in the shell layer, there is no need to add a charge control agent to the toner core.

Specific examples of the positively chargeable charge control agent include azine compounds such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes containing an azine compound such as azine fast red FC, azine fast red 12BK, azine violet BO, azine brown 3G, azine light brown GR, azine dark green BH/C, azine deep black EW, and azine deep black 3RL; nigrosine compounds such as nigrosine, nigrosine salts, and nigrosine derivatives; acidic dyes containing a nigrosine compound such as nigrosine BK, nigrosine NB, and nigrosine Z; metal salts of naphthenic acid or higher fatty acid; alkoxylated amine; alkyl amide; and quaternary ammonium salts such as benzyldecylhexylmethyl ammonium chloride, and decyl trimethyl ammonium chloride. Among these positively chargeable charge control agents, nigrosine compounds are particularly preferably used because a rapider charge rising property can be attained by them. Two or more of these positively chargeable charge control agents may be used in combination.

A resin having a quaternary ammonium salt, a carboxylate, or a carboxyl group can be used as the positively chargeable charge control agent. Specific examples of such a resin include styrene based resins having a quaternary ammonium salt, acrylic resins having a quaternary ammonium salt, styrene acrylic resins having a quaternary ammonium salt, polyester based resins having a quaternary ammonium salt, styrene based resins having a carboxylate, acrylic resins having a carboxylate, styrene acrylic resins having a carboxylate, polyester based resins having a carboxylate, styrene based resins having a carboxyl group, acrylic resins having a carboxyl group, styrene acrylic resins having a carboxyl group, and polyester based resins having a carboxyl group. Such a resin may be an oligomer or a polymer.

Specific examples of the negatively chargeable charge control agent include organic metal complexes and chelate compounds. As the organic metal complexes and the chelate compounds, acetylacetone metal complexes such as aluminum acetyl acetonate and iron (II) acetyl acetonate, salicylic acid metal complexes and salicylic acid metal salts such as chromium 3,5-di-tert-butylsalicylate are preferably used. A salicylic acid metal complex or salicylic acid metal salt is more preferably used. Two or more of these negatively chargeable charge control agents may be used in combination.

The amount of the positively chargeable or negatively chargeable charge control agent to be used is preferably 0.5 part by mass or more and 20.0 parts by mass or less, more preferably 1.0 part by mass or more and 15.0 parts by mass or less assuming that the total mass of the toner is 100 parts by mass.

[Magnetic Powder]

The toner core may contain a magnetic powder in the binder resin if necessary. A toner containing toner particles produced by using such a toner core containing a magnetic powder is used as a magnetic one-component developer. Examples of a suitable material of the magnetic powder include iron such as ferrite and magnetite; ferromagnetic metals such as cobalt and nickel; alloys containing iron and/or a ferromagnetic metal; compounds containing iron and/or a ferromagnetic metal; ferromagnetic alloys having been ferromagnetized by heating or the like; and chromium dioxide.

The particle size of the magnetic powder is preferably 0.1 μm or more and 1.0 μm or less, and more preferably 0.1 μm or more and 0.5 μm or less. Where a magnetic powder having a particle size falling in this range is used, the magnetic powder can be easily homogeneously dispersed in the binder resin.

The amount of the magnetic powder to be used in a toner working as a one-component developer is preferably 35 parts by mass or more and 60 parts by mass or less, and more preferably 40 parts by mass or more and 60 parts by mass or less assuming that the total amount of the toner is 100 parts by mass. Further, the amount of the magnetic powder to be used in a toner contained in a two-component developer is preferably 20 parts by mass or less, and more preferably 15 parts by mass or less assuming that the total amount of the toner is 100 parts by mass.

[Resin Constituting Shell Layer]

The resin constituting the shell layer contains the unit derived from the monomer of the thermosetting resin and the unit derived from the thermoplastic resin. It is noted that the unit derived from the monomer of the thermosetting resin means, in the present application and the appended claims, a unit obtained by introducing a methylene group (—$CH_2$—) derived from formaldehyde into a monomer such as melamine, for example.

The resin constituting the shell layer is formed through a reaction between the monomer of the thermosetting resin and the thermoplastic resin. The unit derived from the thermoplastic resin is crosslinked by the unit derived from the monomer of the thermosetting resin. Therefore, the shell layer of the toner of the present embodiment has suitable flexibility owing to the unit derived from the thermoplastic resin as well as suitable mechanical strength owing to a three-dimensional crosslinked structure formed by the monomer of the thermosetting resin. Accordingly, the shell layer of the toner of the present embodiment is not easily broken during storage or transportation but is easily broken by applying heat and pressure in fixing the toner. For these reasons, the toner of the present embodiment is excellent in the high-temperature preservability and the low-temperature fixability even if the shell layer is thin. Now, materials suitably used for forming the resin constituting the shell layer (i.e., examples of the monomer of the thermosetting resin, and the thermoplastic resin) will be described.

(Monomer of Thermosetting Resin)

A monomer or a prepolymer used for introducing the unit derived from the monomer of the thermosetting resin into the resin constituting the shell layer is a monomer or a prepolymer used in forming one or more thermosetting resins selected from the group of amino resins consisting of a melamine resin, a urea resin, and a glyoxal resin.

The melamine resin is a polycondensate of melamine and formaldehyde. A monomer used for forming the melamine resin is melamine. The urea resin is a polycondensate of urea and formaldehyde. A monomer used for forming the urea resin is urea. The glyoxal resin is a polycondensate of a reactant between glyoxal and urea, and formaldehyde. A monomer used for forming the glyoxal resin is a reactant between glyoxal and urea. Each of the melamine used for forming the melamine resin, the urea used for forming the urea resin, and the urea to be reacted with glyoxal may be modified by a known method. The monomer of the thermosetting resin may be methylolated (derivatized) by formaldehyde before reacting with the thermoplastic resin.

The shell layer of the toner of the present embodiment contains nitrogen atoms derived from melamine or urea. Therefore, the toner of the present embodiment having the shell layer containing the nitrogen atoms can be easily positively charged. For this reason, it can be considered that the toner particles contained in the toner of the present embodiment can be easily positively charged to have a desired charge amount. In order to positively charge the toner particles contained in the toner to have a desired charge amount, the content of the nitrogen atoms in the shell layer is preferably 10% by mass or more.

(Thermoplastic Resin)

The thermoplastic resin used for introducing the unit derived from the thermoplastic resin into the resin constituting the shell layer is preferably a thermoplastic resin having a functional group reactive with a functional group (such as a methylol group or an amino group) of the aforementioned monomer of the thermosetting resin. Examples of the functional group reactive with a methylol group or an amino group include functional groups including an active hydrogen atom such as a hydroxyl group, a carboxyl group, and an amino group. An amino group may be contained in the thermoplastic resin in the form of a carbamoyl group (—$CONH_2$). The thermoplastic resin is preferably a resin containing a unit derived from (meth)acrylamide, or a resin containing a unit derived from a monomer having a functional group such as a carbodiimide group, an oxazoline group, or a glycidyl group because the shell layer can be easily formed when such a resin is used.

Specific examples of the thermoplastic resin used for forming the shell layer include acrylic resins, styrene-(meth) acrylic copolymer resins, silicone-(meth)acrylic graft copolymers, polyurethane resins, polyester resins, polyvinyl alcohols, and ethylene vinyl alcohol copolymers. Such resins may contain a unit derived from a monomer having a functional group such as a carbodiimide group, an oxazoline group, or a glycidyl group. Among these resins, the thermoplastic resin is preferably an acrylic resin, a styrene-(meth) acrylic copolymer resin, or a silicone-(meth)acrylic graft copolymer, and is more preferably an acrylic resin.

Examples of a (meth)acrylic monomer usable for preparing the acrylic resin include (meth)acrylic acid; alkyl ester (meth)acrylate such as methyl (meth)acrylate, ethyl (meth) acrylate, n-propyl (meth)acrylate, or n-butyl (meth)acrylate; aryl ester (meth)acrylate such as phenyl (meth)acrylate; hydroxyalkyl ester (meth)acrylate such as 2-hydroxyethyl (meth)acrylate, 3-hydroxypropyl (meth)acrylate, 2-hydroxypropyl (meth)acrylate, or 4-hydroxybutyl (meth)acrylate; (meth)acrylamide; an ethylene oxide adduct of (meth)acrylic acid; alkyl ether, such as methyl ether, ethyl ether, n-propyl ether, or n-butyl ether, of an ethylene oxide adduct of (meth) acrylic ester.

The shell layer is formed preferably in an aqueous medium. Thus, elution of a mold releasing agent component contained in the toner core, or dissolution of the binder resin can be reduced. The thermoplastic resin used for forming the shell layer is preferably water-soluble. Further, the thermoplastic resin used for forming the shell layer is preferably a resin that can chemically bind to both of the monomer of the thermosetting resin and the toner core in an aqueous medium. An aqueous solution of the thermoplastic resin is preferably used for forming the shell layer.

A ratio (Ws/Wp), in the resin constituting the shell layer, of a content (Ws) of the unit derived from the monomer of the thermosetting resin to a content (Wp) of the unit derived from the thermoplastic resin is preferably 3/7 or more and 8/2 or less, and more preferably 4/6 or more and 7/3 or less.

The thickness of the shell layer is preferably 1 nm or more and 20 nm or less, and more preferably 1 nm or more and 10 nm or less. Where an image is formed by using a toner containing toner particles having a too thick shell layer, the shell layer is difficult to break in fixing the toner onto a recording medium even if a pressure is applied to the toner particles. Further, the binder resin and the mold releasing agent contained in the toner core are not rapidly softened or molten. Hence, the toner is difficult to fix on a recording medium in a low temperature region. By contrast, where the shell layer is too thin, the strength of the shell layer is low. Where the strength of the shell layer is low, the shell layer may be broken by impact caused in a situation of transportation or the like. Moreover, where the toner is stored at a high temperature, toner particles having a shell layer at least partly broken are easily aggregated. This is because a component of the mold releasing agent or the like can easily exude onto the surface of the toner particle through a broken portion of the shell layer.

The thickness of the shell layer can be measured by analyzing a TEM image of the cross-section of the toner particle by using commercially available image analysis software. As the commercially available image analysis software, for example, WinROOF (manufactured by MITANI CORPORATION) can be used.

Where the shell layer is too thin, it may be difficult to measure the thickness of the shell layer because the interface between the shell layer and the toner core is unclear on a TEM image. In such a case, with a TEM image combined with energy dispersive X-ray spectroscopic analysis (EDX), mapping of an element characteristic to the material of the shell layer (such as nitrogen) is performed on the TEM image, so as to clear the interface between the shell layer and the toner core. Then, the thickness of the shell layer is measured.

The thickness of the shell layer may be adjusted by adjusting the amounts of the materials to be used for forming the shell layer (such as the monomer of the thermosetting resin, and the thermoplastic resin). The thickness of the shell layer can be presumed, for example, based on the specific surface area of the toner core, the amount of the monomer of the thermosetting resin, and the amount of the thermoplastic resin in accordance with the following formula:

Thickness of shell layer=(amount of monomer of thermosetting resin+amount of thermoplastic resin)/specific surface area of toner core

[External Additive]

In the toner particles contained in the toner of the present embodiment, an external additive may be attached to the surface of the toner mother particles as occasion demands.

Examples of the external additive include silica and a metal oxide (such as aluminum, titanium oxide, magnesium oxide, zinc oxide, strontium titanate, or barium titanate).

The external additive has a particle size of preferably 0.01 μm or more and 1.0 μm or less.

The amount of the external additive to be used is preferably 1 part by mass or more and 10 parts by mass or less, and more preferably 2 parts by mass or more and 5 parts by mass or less based on 100 parts by mass of toner mother particles.

[Carrier]

The toner can be mixed with a desired carrier to be used as a two-component developer. In preparing a two-component developer, a magnetic carrier is preferably used.

An example of a suitable carrier includes one obtained by coating a carrier core with a resin. Specific examples of the carrier core include a particle of a material such as iron, oxidized iron, reduced iron, magnetite, copper, silicon steel, ferrite, nickel, or cobalt; a particle of an alloy of such a material and manganese, zinc, or aluminum; a particle of an iron-nickel alloy or an iron-cobalt alloy; a particle of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and a particle of a high-dielectric constant material such as ammonium dihydrogen phosphate, potassium dihydrogen phosphate, or Rochelle salt. A resin carrier containing any of these particles (magnetic particles) dispersed in a resin may be used as a carrier.

Specific examples of the resin coating the carrier core include acrylic polymers, styrene based polymers, styrene-(meth)acrylic copolymers, olefin based polymers (such as polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (such as polytetrafluoroethylene, polychlorotrifluoroethylene, or polyvinylidene fluoride), phenol resins, xylene resins, diallyl phthalate resins, polyacetal resins, and amino resins. Two or more of these resins may be used in combination.

The carrier has a particle size, measured by using an electron microscope, of preferably 20 μm or more and 120 μm or less, and more preferably 25 μm or more and 80 μm or less.

Where the toner is used in a two-component developer, the content of the toner in the two-component developer is preferably 3% by mass or more and 20% by mass or less, and more preferably 5% by mass or more and 15% by mass or less based on the mass of the two-component developer.

[Method for Producing Toner]

As a method for producing the toner, a method in which the toner core can be coated with the shell layer of any of the aforementioned prescribed materials is preferably employed. Now, a method for producing the toner core and a method for forming the shell layer employed in a suitable method for producing the electrostatic latent image developing toner of the present disclosure will be successively described.

(Method for Producing Toner Core)

As a method for producing the toner core, a method in which the components such as a colorant, a charge control agent, a mold releasing agent, and a magnetic powder can be satisfactorily dispersed in the binder resin is preferably employed. Examples of the method for producing the toner core include an aggregation method and a melt kneading method. A toner core with high sphericity can be more easily produced by the aggregation method than by the melt kneading method. A toner core having uniform shape and particle size can be more easily produced by the aggregation method. A toner core can be produced more easily by the melt kneading method than by the aggregation method.

According to the aggregation method, aggregated particles are obtained by aggregating particulates containing a component constituting the toner core such as a binder resin, a mold releasing agent, or a colorant in an aqueous medium. Subsequently, the obtained aggregated particles are heated to allow the component contained in the aggregated particles to coalesce. Thus, an aqueous dispersion containing the toner core is obtained. Thereafter, a component of a dispersant or the like is removed from the aqueous dispersion, thereby obtaining the toner core.

In the melt kneading method, a binder resin is mixed with a component of a colorant, a mold releasing agent, a charge control agent, or a magnetic powder. Subsequently, the obtained mixture is melt kneaded. Then, the obtained melt kneaded substance is pulverized and classified. Thus, the toner core with a desired particle diameter can be obtained.

A zeta-potential, measured in an aqueous medium adjusted to pH 4 (specifically, a zeta-potential measured by a method described later), of the toner core is preferably negative (i.e., less than 0 mV).

More specifically, where a shell layer is formed on the surface of a toner core in an aqueous medium, there is a tendency that a shell layer that covers the entire surface of the toner core (or a shell layer having a high coverage) cannot be formed on the surface of a toner core unless toner cores are highly dispersed in the aqueous medium containing a dispersant. However, where the zeta potential of the toner core is negative, the monomer or the prepolymer of the thermosetting resin, as a nitrogen-containing compound positively charged in an aqueous medium, is probably electrically drawn to the toner core negatively charged in the aqueous medium. Further, a reaction between the monomer or the prepolymer of the thermosetting resin having been adsorbed onto the toner core (reaction between the monomers, between the prepolymers, or between the monomer and the prepolymer) or a reaction between the monomer or the prepolymer of the thermosetting resin and the thermoplastic resin satisfactorily proceeds on the surface of the toner core. Thus, where the zeta potential of the toner core is negative, the shell layer can be easily formed uniformly on the surface of the toner core even if the toner cores are not highly dispersed in the aqueous medium by using a dispersant.

An example of a method for producing a toner core showing negative polarity in zeta potential is a method in which the surface of toner core is coated with an anionic dispersant by dispersing the toner cores in an aqueous medium containing the anionic dispersant. In order to form a shell layer on a toner core adjusted to show negative polarity in zeta potential by the above method, it is preferable to form a shell layer on the surface of a toner core by adding shell materials (materials used for forming the shell layer) such as cationic amino resin to an aqueous dispersion containing the toner core. However, the above method uses the dispersant, and therefore, residual dispersant remaining after washing the toner core may inhibit charging of the toner particle.

Accordingly, in producing the toner, it is preferable that a monomer and/or a prepolymer of a thermosetting resin and a thermoplastic resin are attached directly to the surface of a toner core in an aqueous medium without using a dispersant for in-situ polymerization to form a shell layer on the surface of the toner core. A shell layer is formed in an aqueous medium in such a toner producing method. For this reason, it is easy to attach materials of a shell layer to the surface of a toner core for uniform formation of the shell layer (film formation). It is noted that many components such as a colorant or a mold releasing agent tend to be present on the surface of a toner core. Such the components have insufficient adhesiveness to materials of a shell layer in many cases. In turn, portions of the surface of a toner core where components of a colorant or a mold releasing agent are present tend to be portions to be broken (breaking points) in application of heat and pressure to toner particles under a given condition. Further, where many components of a colorant or a mold releasing agent are present on the surface of a toner core, a plurality of breaking points tend to be formed in a shell layer, thereby readily causing the components of the toner core to flow out from the breaking points. In addition, where a shell layer is formed after particulates are attached to the surface of a toner core, breaking points tend to be formed in the vicinity of the particulates in fixing.

Where the toner core showing negative polarity in the zeta potential is used, it seems as described above that a toner particle containing a toner core entirely coated with a shell layer (so as not to expose the surface of the toner core) can be easily obtained without using a dispersant. Besides, where the toner is produced without using a dispersant that causes extremely high drainage load, the concentration of total organic carbon in a drainage can be probably reduced to a low level (of, for example, 15 mg/L or less) without diluting the drainage discharged in toner production.

<Method for Measuring Zeta Potential in Dispersion of pH 4>

Zero point two (0.2) g of a toner core, 80 g of ion exchanged water, and 20 g of 1 mass % nonionic surfactant (e.g., "K-85" manufactured by NIPPON SHOKUBAI CO., LTD.) are mixed by using a magnetic stirrer, so as to homogeneously disperse the toner cores in the resulting liquid. Thus, a dispersion is obtained. Thereafter, dilute hydrochloric acid is added to the dispersion to adjust the pH of the dispersion to 4. Thus, a toner core dispersion of pH 4 (measurement sample) is obtained. The zeta potential of the toner core in the measurement sample is measured by using a zeta potential and particle size analyzer (e.g., "Delsa Nano HC" manufactured by Beckman Coulter Inc.).

(Method for Forming Shell Layer)

The shell layer coating the toner core can be formed by causing a reaction between the monomer or the prepolymer of the thermosetting resin (melamine, urea, or a reactant between glyoxal and urea) and the thermoplastic resin. In order to prevent dissolution of the binder resin or exudation of the mold releasing agent contained in the toner core into a solvent used for forming the shell layer, the shell layer is preferably formed in an aqueous medium such as water.

The shell layer is formed preferably by adding the toner core to an aqueous solution of the shell materials (materials used for forming the shell layer). Examples of a method for satisfactorily dispersing toner cores in an aqueous medium after addition of the toner cores to the aqueous medium include a method in which the toner cores are mechanically dispersed in an aqueous medium by using an apparatus capable of powerfully stirring a dispersion (hereinafter referred to as the first dispersion method), and a method in which the toner cores are dispersed in the aqueous medium containing a dispersant (hereinafter referred to as the second dispersion method). In the second dispersion method, the toner cores are readily dispersed in the aqueous medium in a homogeneous manner. Therefore, a shell layer that entirely covers the toner core (so as not to expose the surface of the toner core) can be readily formed by the second dispersion method. By contrast, total organic carbon in a drainage can be reduced in the first dispersion method. A suitable example of the stirrer used in the first dispersion method includes HIVIS MIX (manufactured by PRIMIX Corporation).

The pH of the aqueous dispersion containing the toner core is preferably adjusted to approximately 4 by using an acidic substance before forming the shell layer. By adjusting the pH of the dispersion to be on the acidic side, condensation polymerization of the shell materials (materials used for forming the shell layer) tends to be accelerated.

After adjusting the pH of the aqueous dispersion containing the toner core, the materials used for forming the shell layer may be dissolved in the aqueous dispersion containing the toner core as occasion demands. Thereafter, the reaction between the shell materials used for forming the shell layer is allowed to proceed on the surface of the toner core in the aqueous dispersion, thereby forming the shell layer coating the surface of the toner core.

The temperature at which the shell layer is formed by causing the reaction between the monomer or the prepolymer of the thermosetting resin and the thermoplastic resin is preferably 40° C. or more and 95° C. or less, and more preferably 50° C. or more and 80° C. or less. Where the shell layer is formed at a temperature of 40° C. or more and 95° C. or less, the formation of the shell layer can satisfactorily proceed.

Where the toner core contains a binder resin having a hydroxyl group or a carboxyl group (such as a polyester resin), formation of the shell layer at a temperature of 40° C. or more and 95° C. or less may cause reaction of the hydroxyl group or the carboxyl group exposed on the surface of the toner core with the methylol group of the monomer or the prepolymer of the thermosetting resin. This tends to form a covalent bond between the binder resin constituting the toner core and the resin constituting in the shell layer. As a result, the shell layer is readily and firmly attached to the toner core.

After forming the shell layer as described above, the aqueous dispersion containing the toner core coated with the shell layer is cooled to room temperature. Thus, a dispersion of toner mother particles can be obtained. Thereafter, a washing process for washing the toner mother particles, a drying process for drying the toner mother particles, and an external addition process for attaching an external additive to the surfaces of the toner mother particles are successively performed. Then, a toner is collected from the dispersion of the toner mother particles. The washing process, the drying process, and the external addition process will now be described. It is noted that any of the washing process, the drying process, and the external addition process may be appropriately omitted.

(Washing Process for Toner Mother Particles)

The toner mother particles are washed with water if necessary. A suitable example of a method for washing the toner mother particles includes a method in which the toner mother particles are collected as a wet cake by solid-liquid separating the toner mother particles from the aqueous medium containing the toner mother particles by a centrifugal separation method and a filter press method, and the obtained wet cake is washed with water.

(Drying Process for Toner Mother Particles)

The toner mother particles may be dried if necessary. A suitable method for drying the toner mother particles may a method using a dryer such as a spray dryer, a fluidized-bed dryer, a vacuum freeze dryer, or a vacuum dryer. A spray dryer is more preferably used for reducing the aggregation of the toner mother particles during the drying process. Where a spray dryer is used, an external additive such as silica may be attached to the surfaces of the toner mother particles by spraying, together with the dispersion of the toner mother particles, a dispersion of the external additive.

(External Addition Process)

An external additive may be attached to the surfaces of the toner mother particles obtained as described above if necessary. A suitable example of a method for attaching an external additive to the surfaces of the toner mother particles may be a method in which the toner mother particles and the external additive are mixed by using a mixer such as an FM mixer or a Nauta mixer under conditions where the external additive is not buried in a surface portion of the toner mother particle. By attaching the external additive to the surfaces of the toner mother particles, the toner particles are obtained. Where no external additive is attached to the surfaces of the toner mother particles (that is, the external addition process is omitted), the toner mother particles correspond to the toner particles.

The electrostatic latent image developing toner of the present embodiment described so far is excellent in the high-temperature preservability and the low-temperature fixability. Therefore, the electrostatic latent image developing toner of the present embodiment can be suitably used in any of various image forming apparatuses.

EXAMPLES

Now, examples of the present disclosure will be described. It is noted that the present disclosure is not limited to the scope of the following examples at all.

[Production of Polyester Resin]

In accordance with the following method, polyester resins A-D having glass transition points (Tg), softening points (Tm), number average molecular weights (Mn), molecular weight distributions (Mw/Mn), acid values, and hydroxyl values listed in Table 1 below were produced.

TABLE 1

| Polyester resin | A | B | C | D |
|---|---|---|---|---|
| Tg [° C.] | 53.8 | 45.0 | 50.0 | 50.0 |
| Tm [° C.] | 100.5 | 90.0 | 90.0 | 90.0 |
| Number average molecular weight (Mn) | 1,460 | 1,260 | 1,350 | 1,150 |
| Molecular weight distribution (Mw/Mn) | 12.7 | 10.5 | 20.9 | 15.5 |
| Acid value [mgKOH/g] | 16.8 | 20.0 | 3.0 | 20.0 |
| Hydroxyl value [mgKOH/g] | 22.8 | 50.0 | 10.0 | 40.0 |

(Production of Polyester Resin A)

A 5 L four-necked flask was charged with 1245 g of terephthalic acid, 1245 g of isophthalic acid, 1248 g of bisphenol A ethylene oxide adduct, and 744 g of ethylene glycol. Subsequently, after replacing the atmosphere inside the flask with nitrogen, the temperature within the flask was increased to 250° C. under stirring. Then, after the reaction was performed at normal pressure and 250° C. for 4 hours, 0.875 g of antimony trioxide, 0.548 g of triphenyl phosphate, and 0.102 g of tetrabutyl titanate were added to the flask. Thereafter, the pressure within the flask was reduced to 0.3 mmHg, and the temperature within the flask was increased to 280° C. Subsequently, the reaction was performed at 280° C. for 6 hours to give a polyester resin having a number average molecular weight of 1,300. Then, 30.0 g of trimellitic acid was added as a crosslinking agent to the flask. Then, the pressure within the flask was restored to normal pressure, and the temperature within the flask was lowered to 270° C. Thereafter, the contents within the flask were reacted at normal pressure and 270° C. for 1 hour. After completing the reaction, the content of the flask was taken out and cooled, thereby giving the polyester resin A.

(Production of Polyester Resin B)

The polyester resin B was obtained in the same manner as in the production of the polyester resin A except that the additive amount of trimellitic acid (crosslinking agent) was changed from 30 g to 10 g.

[Production of Polyester Resin C]

The polyester resin C was obtained in the same manner as in the production of the polyester resin A except that 1248 g of bisphenol A propylene oxide adduct was used as an alcohol component rather than 1248 g of bisphenol A ethylene oxide adduct.

(Production of Polyester Resin D)

The polyester resin D was obtained in the same manner as in the production of the polyester resin A except that 1120.5 g of terephthalic acid and 124.5 g of succinic acid were used rather than 1245 g of terephthalic acid by changing terephthalic acid to saccinic acid by the amount corresponds to 10 mass % (124.5 g).

Method for Producing Toners According to Examples 1-9

Production of Toner Cores

Toner cores were produced by using polyester resins of which types are shown in Tables 2-4 below.

TABLE 2

| | Example 1 | Example 2 | Example 3 | Example 4 |
|---|---|---|---|---|
| Toner core | | | | |
| Type of polyester resin | A | A | A | A |
| Zeta-potential [mV] | −10 | −10 | −10 | −10 |
| Shell layer | | | | |
| Additive amount of methylol melamine aqueous solution [mL] | 1.5 | 2.0 | 3.0 | 4.5 |
| Additive amount of aqueous solution of thermoplastic resin [mL] | 1.5 | 2.0 | 3.0 | 4.5 |
| Number of points where melt flows out | Plural | Plural | Plural | Plural |
| Thickness of shell layer [nm] | 6.0 | 8.0 | 12.0 | 20.0 |
| Sa [$m^2$/g] | 1.06 | 1.17 | 1.21 | 1.31 |
| Sb [$m^2$/g] | 1.90 | 1.75 | 1.60 | 1.60 |
| Sx [%] | 80.0 | 50.2 | 31.7 | 21.7 |
| Heat resistant preservability | | | | |
| Degree of aggregation [mass %] | 15 | 10 | 5 | 3 |
| Evaluation | Good | Good | Good | Good |
| Low-temperature fixability | | | | |
| Lowest fixing temperature [° C.] | 140 | 145 | 150 | 155 |
| Evaluation | Good | Good | Good | Good |

TABLE 3

| | Example 5 | Example 6 | Example 7 |
|---|---|---|---|
| Toner core | | | |
| Type of polyester resin | B | B | B |
| Zeta-potential [mV] | −10 | −10 | −10 |

TABLE 3-continued

| | Example 5 | Example 6 | Example 7 |
|---|---|---|---|
| Shell layer | | | |
| Additive amount of methylol melamine aqueous solution [mL] | 1.5 | 2.0 | 3.0 |
| Additive amount of aqueous solution of thermoplastic resin [mL] | 1.5 | 2.0 | 3.0 |
| Number of points where melt flows out | Plural | Plural | Plural |
| Thickness of shell layer [nm] | 6.0 | 8.0 | 12.0 |
| Sa [$m^2/g$] | 1.23 | 1.31 | 1.35 |
| Sb [$m^2/g$] | 2.01 | 1.80 | 1.60 |
| Sx [%] | 64.0 | 37.9 | 18.3 |
| Heat resistant preservability | | | |
| Degree of aggregation [mass %] | 15 | 10 | 5 |
| Evaluation | Good | Good | Good |
| Low-temperature fixability | | | |
| Lowest fixing temperature [° C.] | 140 | 145 | 150 |
| Evaluation | Good | Good | Good |

TABLE 4

| | Example 8 | Example 9 | Comparative Example 1 |
|---|---|---|---|
| Toner core | | | |
| Type of polyester resin | C | D | A |
| Zeta-potential [mV] | −10 | −5 | −10 |
| Shell layer | | | |
| Additive amount of methylol melamine aqueous solution [mL] | 2.0 | 2.0 | 3.0 |
| Additive amount of aqueous solution of thermoplastic resin [mL] | 4.0 | 4.0 | — |
| Number of points where melt flows out | Plural | Plural | One |
| Thickness of shell layer [nm] | 8.0 | 8.0 | 8.0 |
| Sa [$m^2/g$] | 1.11 | 1.20 | 1.06 |
| Sb [$m^2/g$] | 2.01 | 2.40 | 1.76 |
| Sx [%] | 81.4 | 99.5 | 66.3 |
| Heat resistant preservability | | | |
| Degree of aggregation [mass %] | 5 | 2 | 15 |
| Evaluation | Good | Good | Good |
| Low-temperature fixability | | | |
| Lowest fixing temperature [° C.] | 140 | 140 | 170 |
| Evaluation | Good | Good | Poor |

Mixtures were obtained by mixing 100 parts by mass of respective polyester resins listed in Tables 2-4, 5 parts by mass of a colorant (C. I. pigment blue 15:3, copper phthalocyanine), and 5 parts by mass of a mold releasing agent ("WEP-3" manufactured by NOF Corporation, ester wax) by using a mixer (FM mixer). Next, each mixture is melt kneaded by using a two screw extruder ("PCM-30" manufactured by Ikegai Corp.) to obtain a kneaded substance. Then, the kneaded substance was pulverized by using a mechanical pulverizer ("Turbo Mill" manufactured by FREUND-TURBO CORPORATION) to obtain a pulverized substance. Subsequently, the pulverized substance was classified by using a classifier ("Elbow Jet" manufactured by Nittetsu Mining Co., Ltd.) to obtain toner cores with a volume average particle diameter ($D_{50}$) of 6.0 μm. The volume average particle diameter of the toner cores was measured by using "Coulter Counter Multisizer 3" manufactured by Beckman Coulter Inc.

The zeta-potential of a part of the obtained toner cores in a dispersion of pH 4 was measured in accordance with the following method. Each zeta-potential of the toner cores in the dispersion of pH 4 is indicated in Tables 2-4.

<Method for Measuring Zeta Potential in Dispersion of pH 4>

Zero point two (0.2) g of the toner cores, 80 g of ion exchanged water, 20 g of 1 mass % nonionic surfactant ("K-85" manufactured by NIPPON SHOKUBAI CO., LTD., polyvinylpyrrolidone) were mixed by using a magnet stirrer. Then, the resultant toner cores were homogenously dispersed in the liquid to obtain a dispersion. Thereafter, dilute hydrochloric acid was added to the dispersion to adjust the pH of the dispersion to 4. In this manner, a toner core dispersion of pH 4 (measurement sample) was obtained. Then, the zeta-potential was measured with the obtained pH 4 dispersion of the toner cores as a measurement sample. Specifically, the zeta potential of the toner cores in the measurement sample was measured by using a zeta potential and particle size analyzer (e.g., "Delsa Nano HC" manufactured by Beckman Coulter Inc.).

(Formation of Shell Layer)

A 1 L three-necked flask equipped with a thermometer and a stirring blade was charged with 300 mL of ion exchanged water. Subsequently, the temperature within the flask was retained at 30° C. by using a water bath. Then, dilute hydrochloric acid was added to the flask to adjust the pH of an aqueous medium contained in the flask to 4. After adjusting the pH, a methylol melamine aqueous solution ("Milben 607" manufactured by Showa Denko K.K., having a solid content concentration of 80% by mass) of which amount is listed in Tables 2-4 and an aqueous solution of the thermoplastic resins (i.e., an aqueous solution of water soluble polyacrylamide having a solid content concentration of 11% by mass) of which amount is listed in Tables 2-4 were added to the flask as shell materials (materials used for forming the shell layer). Then, the contents of the flask were stirred, thereby dissolving the shell materials in the aqueous medium. In this manner, an aqueous solution (A) of the shell materials was obtained.

To the aqueous solution (A), 300 g of the corresponding type of toner core shown in Tables 2-4 was added. Then, the contents of the flask were stirred at a stirring rate of 200 rpm for 1 hour. Subsequently, 300 mL of ion exchanged water was added to the flask. Then, while the contents of the flask was stirred at 100 rpm, the temperature within the flask was increased up to 70° C. at a rate of 1° C./min. Thereafter, the contents of the flask were continuously stirred for 2 hours under conditions of 70° C. and 100 rpm. After stirring, the pH of the content of the flask was adjusted to 7 by adding sodium hydroxide to the flask. Then, the content of the flask was cooled to room temperature. In this manner, a dispersion containing toner mother particles was obtained.

(Washing Process)

The toner mother particles was filtered out by using a Buchner funnel from the dispersion containing the toner mother particles to obtain a wet cake of the toner mother particles. The wet cake of the toner mother particles was dispersed again in ion exchanged water to wash the toner mother particles. Such filtration and dispersion were repeated five times to wash the toner mother particles.

(Drying Process)

A slurry was prepared by dispersing the wet cake of the toner mother particles in an ethanol aqueous solution in a concentration of 50% by mass. The obtained slurry was supplied to a continuous surface modifying apparatus ("Coatmizer" manufactured by Freund Corporation) to dry the toner mother particles contained in the slurry. In this manner, dried toner mother particles were obtained. The drying conditions employed in using Coatmizer were a hot air temperature of 45° C. and a blower air flow rate of 2 $m^3$/min.

(External Addition Process)

A hundred (100) parts by mass of the toner mother particles resulting from the drying process and 1.5 part by mass of silica ("REA90" manufactured by Nippon Aerosil Co., Ltd.) were mixed for 5 minutes by using a 10 L FM mixer (manufactured by Nippon Coke & Engineering Co., Ltd.) to attach the external additive to the toner mother particles. Thereafter, the resultant toner particles were sifted by a 200 mesh sieve (having an opening of 75 μm).

Method for Producing Toner According to Comparative Example 1

A toner of Comparative Example 1 was obtained in the same manner as in the production of the toner of Example 1A except that the amount of the aqueous solution of methylol melamine was changed to the amount listed in Table 4 and no aqueous solution of the thermoplastic resin was used.

[Evaluation]

Evaluation methods and results of each sample (toners of Examples 1-9 and Comparative Example 1) are as follows.

(Recognition of Point where Melt Flows Out)

Figure 2:
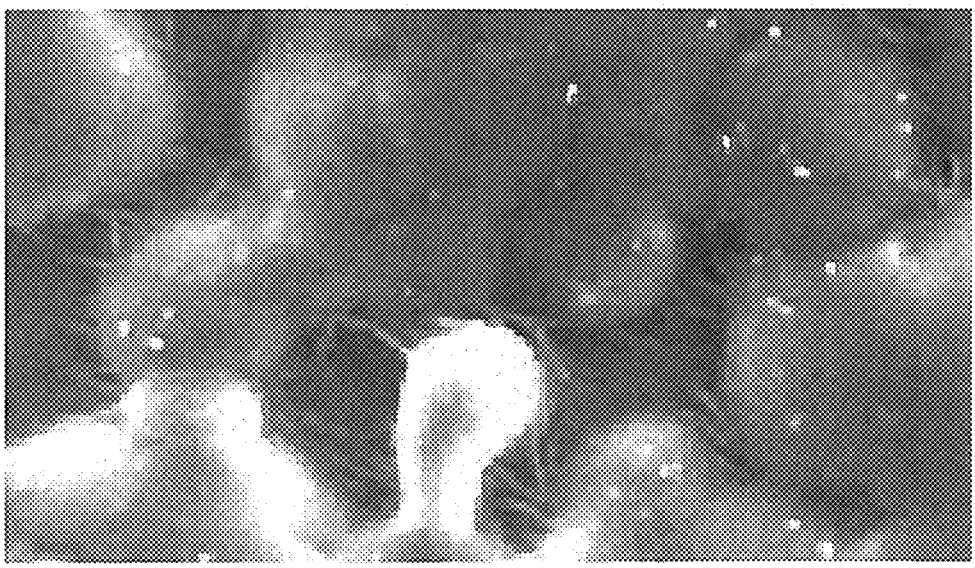
FIG. 2 is a scanning electron micrograph of the surface of a toner particle of a toner to which heat and pressure are applied in Example 1.

Heat and pressure were applied to the toner particles contained in the respective samples (toners) in accordance with the following method. Subsequently, in accordance with the following method, the surfaces of the toner particles to which heat and pressure have been applied were observed by using a scanning electron microscope (SEM) to recognize any points where a melt of a component of the toner core flows out over the outer surface of the shell layer. Tables 2-4 show evaluation results of the toners of Examples 1-9 and Comparative Example 1 (as to whether the number of the points where a melt of the toner core flows out is one or more). Besides, FIG. 2 is a SEM photograph of the surfaces of the toner particles of the toner of Example 1 to which heat and pressure have been applied. It is noted that the surfaces of the toner particles having been subjected to heat and pressure in each toner of Examples 2-9 showed almost similar results to that of the toner of Example 1 (FIG. 2).

The SEM photograph of FIG. 2 shows that many white lines extend on the surface of the toner particles having been subjected to heat and pressure. The many white lines might be tracks of a melt of each toner core flowing out from minute breaking points (points where the shell layer is broken) in the surface of the toner particles. It can be confirmed from FIG. 2 that application of heat and pressure to the toner particles contained in each toner of Examples 1-9 breaks the toner particles in a manner that a melt of a component of the toner core flows out from a plurality of points in the outer surface of the shell layer.

<Method for Applying Heat and Pressure to Toner Particles>

The toner particles contained in the respective samples (toner) were attached to a polyester film so as not to be superimposed, thereby forming a toner layer of a plurality of the toner particles on the polyester film. Then, heat and pressure were applied to the toner layer (in turn, the toner particles of the toner layer) under conditions of a temperature of 140° C. and a pressure of 7 MPa by using a pressure roll (made from rubber) and a heating roll. Specifically, the pressure roll and the heating roll are heated to 100° C. and 140° C., respectively. Then, the film (in turn, the toner layer formed on the film) is allowed to pass between the pressure roll and the heating roll under conditions of a linear velocity of 200 mm/sec. and a nip width of 4.0 mm to apply heat and pressure to the toner particles of the toner layer.

<Method for Recognizing Point where Melt Flows Out>

The toner particles having been subjected to heat and pressure as described above were observed with magnifying powers of 3000 and 10000 by using a scanning electron microscope ("JSM-6700" manufactured by JEOL Ltd.). Then, it was recognized whether the number of points where a melt of a component of the toner core flows out from the surfaces of the toner particles by the application of heat and pressure is one or more.

(Thickness of Shell Layer)

A TEM photograph of the cross-section of the toner particles contained in the respective samples (toners) was taken by a method described below. Further, the thickness of the shell layer was measured by a method described below on the basis of the TEM photograph of the cross-section of the toner particles. Each evaluation result of the toners of Examples 1-9 and Comparative Example 1 (thicknesses of the shell layers to be measured) is shown in Tables 2-4.

<Method for Taking TEM Photograph of Cross-Section of Toner Particles>

The respective samples (toners) were dispersed in a cold-setting epoxy resin. Then, each resultant was allowed to stand still in an atmosphere of 40° C. for 2 days. This gave a cured substance of the toner. The cured substance was dyed with osmium tetroxide. Thereafter, a thin sample with a thickness of 200 nm was cut out from the resulting dyed substance by using a microtome ("EM UC6" manufactured by Leica). The cross section of the thin sample includes a cross section of the toner particle. The obtained thin sample was observed with magnifying powers of 3000 and 10000 by using a transmission electron microscope (TEM) ("JSM-6700F" manufactured by JEOL Ltd.). Besides, a TEM photograph of the cross-section of the toner particle was taken.

<Method for Measuring Thickness of Shell Layer>

The thickness of the shell layer was measured by analyzing the TEM photograph image of the cross-section of the toner particle by using image analysis software ("WinROOF" manufactured by MITANI CORPORATION). Specifically, two straight lines were drawn to cross at substantially the center of the cross-section of the toner particle, and the lengths of four sections of the two straight lines crossing the shell layer were measured. An average of the measured lengths of the four sections was defined as the evaluation value of one toner particle (the thickness of the shell layer of one toner particle to be measured). This measurement of the thickness of the shell layer was performed on ten toner particles of the each sample (toner). Thus, an average of the thicknesses of the shell layer of each ten toner particles to be measured (evaluation value of the toner particles) was defined as the evaluation value of the toner (the thickness of the shell layer of the toner to be measured).

(Rate Sx of Change in Specific Surface Area)

The specific surface Sb of each sample having been treated with alkali in accordance with the following method (toner having been subjected to alkaline treatment) and the specific surface Sa of the sample not subjected to the alkaline treatment (non-treated toner) were measured by using a BET specific surface area measuring device ("HM Model-1208" manufactured by Mountech Co., Ltd.). From the measured Sa and Sb, the rate Sx of change in specific surface area (%) of each toner was calculated in accordance with the equation $Sx=100\times(Sb-Sa)/Sa$. Evaluation results of the toners of Examples 1-9 and Comparative Example 1 (calculated rate Sx of change in specific surface area of each toner) are shown in Tables 2-4.

Figure 3:
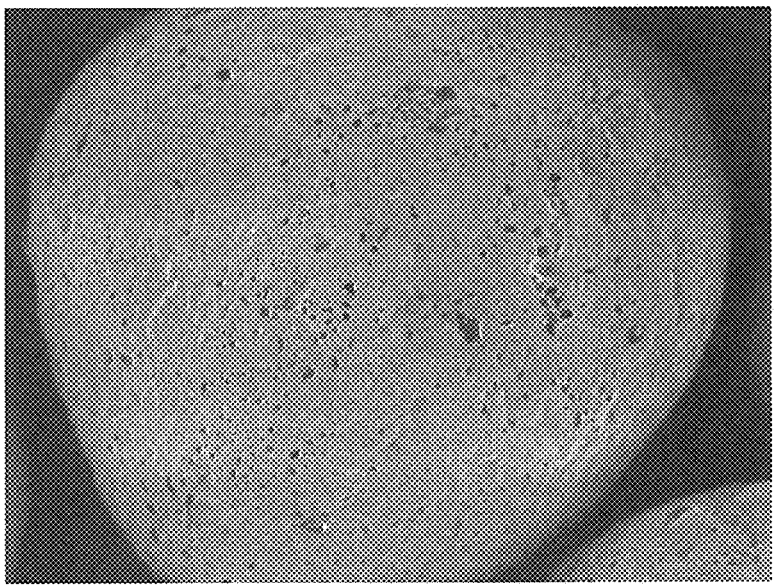
FIG. 3 is a scanning electron micrograph of the surface of a toner particle of a toner having been subjected to alkaline treatment in the first embodiment.

Further, an image of the surfaces of the toner particles subjected to the alkaline treatment in the toner of Example 1 was taken with magnifying powers of 3000 and 10000 by using a scanning electron microscope (SEM). FIG. 3 is a SEM photograph of the surfaces of the toner particles having been subjected to the alkaline treatment in the toner of Example 1. The surfaces of the toner particles having been subjected to the alkaline treatment in the toners of Examples 2-9 and Comparative Example 1 show almost the same results as that of the toner of Example 1 (FIG. 3). FIG. 3 proves that the alkaline treatment performed on toner particles can form many recesses in the surfaces of toner particles.

<Alkaline Treatment>

Ten (10) g of a toner was dispersed in 50 mL of a basic aqueous solution of pH 10 containing an anionic surfactant (an aqueous solution obtained by diluting "Maipetto" manufactured by Kao Corporation 10 times with ion exchanged water) to obtain a dispersion. Subsequently, the obtained dispersion was allowed to stand still at 50° C. for 10 hours. Then, the standing dispersion was subjected to solid-liquid separation (filtration), and the resultant solid content was dried. In this manner, a toner having been subjected to alkaline treatment was obtained.

(Heat Resistant Preservability)

The degree of aggregation of each toner was obtained in accordance with the following method. Then, the high-temperature preservability of the samples (toners) was evaluated from the obtained degree of aggregation. The evaluation results of the toners of Examples 1-9 and Comparative Example 1 (high-temperature preservability of the toners) are shown in Tables 2-4.

<Method for Evaluating High-Temperature Preservability>

Two (2) g of each sample (toner) was weighed in a 20 mL plastic vessel. Then, the resultant was allowed to stand still for 3 hours in a thermostat heated at 60° C. Thus, a toner for high-temperature preservability evaluation was obtained. Then, the toner for high-temperature preservability evaluation was sifted by using a 100 mesh sieve (having an opening of 150 μm) equipped in a powder tester (manufactured by Hosokawa Micron Corporation) under conditions of a rheostat scale of 5 and time of 30 seconds in accordance with an instruction manual of the powder tester. After sifting, the mass of the toner remaining on the sieve was measured. On the basis of the mass of the toner before sifting and the mass of the toner remaining on the sieve after sifting, the degree of aggregation (% by mass) of the toner was obtained in accordance with the following formula. On the basis of the calculated degree of aggregation of the toner, the high-temperature preservability was evaluated in accordance with the following criteria.

Degree of aggregation (% by mass)=(mass of toner remaining on sieve/mass of toner before sifting)×100

Good: The degree of aggregation was 20% by mass or less.

Normal: The degree of aggregation was more than 20% by mass, and 50% by mass or less.

Poor: The degree of aggregation was more than 50% by mass.

(Low-Temperature Fixability)

A two-component developer was prepared with each sample (toner) in accordance with the following method. An image was formed using the prepared two-component developer in accordance with the following method. Then, the low-temperature fixability of the sample (toner) was evaluated. The evaluation results of the toners of Examples 1-9 and Comparative Example 1 (low-temperature fixability of the toners) are shown in Tables 2-4.

<Method for Preparing Two-Component Developer>

By using a ball mill, 100 parts by mass of a developer carrier (carrier for FS-C5250DN) and 10 parts by mass of each sample (toner) were mixed for 30 minutes. In this manner, a two-component developer was prepared.

<Method for Valuating Low-Temperature Fixability>

As an evaluation apparatus, a printer ("FS-C5250DN" manufactured by KYOCERA Document Solutions Inc.) modified so that a fixing temperature could be adjusted was used. The two-component developer prepared by the above described method was supplied to a developing unit of the evaluation apparatus. Then, the toner was supplied to a toner container of the evaluation apparatus. The linear speed of the evaluation apparatus was set to 200 mm/sec, and the toner placement amount of the evaluation apparatus was set to 1.0 mg/cm$^2$. Then, an unfixed solid image was formed on a recording medium (printing paper). The formed unfixed solid image was fixed with the fixing temperature of a fixing unit of the evaluation apparatus increased from 100° C. in increments of 5° C. in a range of the fixing temperature from 100° C. inclusive to 200° C. inclusive. The low-temperature fixability was evaluated in accordance with the following criteria:

Good: The lowest fixing temperature of the toner was 160° C. or less.

Poor: The lowest fixing temperature of the toner was more than 160° C.

The toners of Examples 1-9 each contained the toner particles each including a toner core containing the binder resin and a shell layer coating the surface of the toner core. Further, the shell layer contained the resin having the unit derived from the monomer of the thermosetting resin and the unit derived from the thermoplastic resin. Furthermore, the thermosetting resin is one or more resins selected from the group of amino resins consisting of a melamine resin, a urea resin, and a glyoxal resin. Yet further, when heat and pressure were applied to a toner layer formed on a polyester film under conditions of a temperature of 140° C. and a pressure of 7 MPa so that the toner particles were not superimposed, the toner particles of the toner layer were broken in a manner that a melt of a component of the toner cores flew out from a plurality of points in the outer surface of the shell layer. These toners of Examples 1-9 having such a constitution were excellent in the high-temperature preservability and the low-temperature fixability, as shown in Tables 2-4.

Each toner of Examples 1, 2, 5, 6, 8, and 9 had a rate Sx of change in specific surface area of 35% or more. The toners having such a constitution were excellent in the low-temperature fixability, as indicated in Tables 2-4. One reason might be because many points where a melt of a component of the toner cores were present in the outer surface of the shell layer in each toner of Examples 1, 2, 5, 6, 8, and 9 having a large rate Sx of change in specific surface area.

By contrast, the toner of Comparative Example 1 was inferior to the toners of Examples 1-9 in the low-temperature fixability, as shown in Table 4. It can be thought that without containing a thermoplastic resin, the shell layer in the toner of Comparative Example 1 became hard with a result that the shell layer was hard to be broken by application of heat and pressure to the toner particles.

What is claimed is:

1. An electrostatic latent image developing toner comprising:

toner particles each including a toner core containing a binder resin, and a shell layer coating a surface of the toner core, wherein the shell layer contains an acrylamide polymer crosslinked with methylol melamine, the shell layer has a thickness of 1 nm or more and 20 nm or less, and when toner characteristics are evaluated through a test in which heat and pressure are applied to a toner layer formed on a polyester film under conditions of a temperature of 140° C. and a pressure of 7 MPa so that the toner particles are not superimposed, the toner particles of the toner layer are broken in a manner that a melt of a component of the toner core flows out from a plurality of points in an outer surface of the shell layer.

2. An electrostatic latent image developing toner according to claim 1, wherein a zeta potential, measured in an aqueous medium adjusted to pH 4, of the toner core is negative.

3. An electrostatic latent image developing toner according to claim 1, wherein when toner characteristics are evaluated through an alkaline treatment that involves:

obtaining a dispersion by dispersing 10 g of the toner in 50 mL of a basic aqueous solution of pH 10 containing an anion surfactant;

allowing the obtained dispersion to stand still at a temperature of 50° C. for 10 hours; and drying a solid content separated from the standing dispersion, a rate Sx of change in specific surface area obtained in accordance with an equation $Sx=100\times(Sb-Sa)/Sa$ is 35% or more, where Sb is a specific surface of the toner subjected to the alkaline treatment, and Sa is a specific surface of the toner not subjected to the alkaline treatment.

4. An electrostatic latent image developing toner according to claim 1, wherein a colorant or a mold releasing agent is present in the vicinity of the surface of the toner core.

5. An electrostatic latent image developing toner according to claim 1, wherein the toner core contains a polyester resin as the binder resin.

6. An electrostatic latent image developing toner according to claim 5, wherein the polyester resin has a number average molecular weight of 1,100 or more and 2,000 or less, and a ratio of a mass average molecular weight of the polyester resin relative to the number average molecular weight of the polyester resin is 9 or more and 21 or less.

* * * * *